United States Patent [19]

Plomer et al.

[11] 4,002,514

[45] Jan. 11, 1977

[54] NITROCELLULOSE PROPELLANT COMPOSITION

[75] Inventors: John J. Plomer, Midland; Gerald R. Staudacher, Bay City; Keith Roberson, Freeland, all of Mich.

[73] Assignee: The Dow Chemical Company, Midland, Mich.

[22] Filed: Sept. 30, 1965

[21] Appl. No.: 493,306

[52] U.S. Cl. ..... 149/19.4; 149/19.8; 149/36; 149/92

[51] Int. Cl.[2] ..... C06D 5/06

[58] Field of Search ..... 149/18, 36, 92, 96, 149/19.4, 19.8

[56] References Cited

UNITED STATES PATENTS

| | | | |
|---|---|---|---|
| 3,073,731 | 1/1963 | Cohen | 149/92 |
| 3,222,233 | 12/1965 | Matuszko | 149/96 |
| 3,288,660 | 2/1963 | Niles | 149/36 |
| 3,865,659 | 2/1975 | Flynn et al. | 149/19.4 |

*Primary Examiner*—Leland A. Sebastian
*Attorney, Agent, or Firm*—C. Kenneth Bjork; Lloyd S. Jowanovitz

[57] ABSTRACT

A solid double base propellant comprising from about 5 to about 60 per cent of a specific nitramine oxidizer, from about 5 to about 60 per cent of triaminoguanidinium azide, triaminoguanidinium hydrazinium diazide or mixtures thereof, and from about 35 to about 60 per cent of a plasticized nitrocellulose binder.

5 Claims, No Drawings

NITROCELLULOSE PROPELLANT COMPOSITION

This invention relates to propellants and more particularly is concerned with a novel solid double base propellant which burns smoothly and energetically to produce large volumes of high pressure, cool, inert gaseous products having a low solids content and a high transmittancy both to visible and infrared light.

The need for smokeless and cool burning solid propellants for rocket, missile, gun propellant and gas generator applications is recognized in the propellant art. It is necessary in many cases to transmit infrared guidance or data telemetry signals through the exhaust plume of rockets, for example. These signals can be attenuated by smoke particles. Therefore, the substantial elimination of the number of solid particles in the exhaust products of a rocket propellant composition provides for markedly improved signal transmission. A low flame temperature is of interest in such applications in that this minimizes interference from the exhaust blast stream with the infrared communications signal. Additionally, for those applications where it is desirable to suppress a high temperature exhaust product stream which can be detected by infrared detectors, a cool burning propellant also is needed. Further, substantial elimination of the visible exhaust plume is desired in many instances to avoid detection of a rocket or missile.

It is a principal object of the present invention, therefore, to provide a substantially smokeless propellant having a cool exhaust temperature the exhaust products of which consist almost entirely of gaseous products.

It is another object of the present invention to provide a substantially smokeless cool burning solid propellant, the combustion exhaust products of which contain minimal quantities of unburned carbon, metal oxides, salts, halogens, halogen compounds or other undesirable condensibles.

These and other objects and advantages are realized by the novel propellant composition of the present invention which provides for a high level of oxidation thereby precluding unburned carbon in the exhaust. Additionally, the present novel composition contains at a maximum only a few percent of metal fuel or metal salt additives and contains no chlorine containing oxidizers. Further, the propellant has a low carbon content. The present novel composition contains an energetic binder which in itself is substantially self-oxidizing. The present novel composition burns with a low flame temperature provided by coolant additives in the composition which additives in themselves are not inert but energetic.

The actual composition of the substantially smokeless rocket propellant of the present invention comprises from about 5 to about 60 percent of a nitramine oxidizer, e.g. cyclotrimethylene trinitramine (RDX), cyclotetramethylene tetranitramine (HMX) or mixtures thereof, from about 5 to about 60 percent of triaminoguanidinium azide (TAZ), triaminoguanidinium hydrazinium diazide (THA) or mixtures thereof, from about 35 to about 60 percent of a plasticized nitrocellulose binder, and, may also contain up to a total of about 5 percent of stabilizers and combustion additives. This composition results in a high density, high impulse propellant exhibiting a theoretical impulse of up to about 270 seconds, the flame temperatures in the exhaust of which at a minimum may be as low as about 900° C.

The cured propellant is an elastomeric solid being substantially homogeneous throughout and having good physical integrity and structural strength and of a physical character satisfactory for use in conventional solid rocket motors.

A preferred embodiment of the present novel propellant composition comprises on a weight basis from about 10 to about 12.5 percent plastisol grade nitrocellulose, from about 30 to about 37.5 percent nitroplasticizer, from about 5 to about 55 percent of triaminoguanidinium azide and/or triaminoguanidinium hydrazinium diazide, the balance being RDX, HMX or mixtures of these oxidizers. Additionally, if desired, up to about 2 percent of a metal fuel, such as for example finely divided aluminum or beryllium, and up to about 2.5 percent of a stabilizer such as for example toluene diisocyanate, triacetin, dibutyl sebecate and 2-dinitrodiphenylamine, can be incorporated into the composition. From about 0.5 to about 2 percent of a flame suppressant additive, e.g. alkali metal salts such as lithium carbonate, also can be incorporated into the propellant.

Preferably, as indicated hereinbefore, plasticized nitrocellulose is used as a binder in the present novel composition. Ordinarily, the binder employed in the present invention is a blend containing on a weight basis within the range set forth hereinbefore from about 1 to about 5 parts, preferably about 3 parts of a nitroplasticizer to 1 part of a plastisol grade nitrocellulose (NC). Diethyleneglycol dinitrate (DEGDN), triethyleneglycol dinitrate (TEGDN), trimethylolethane trinitrate (TMETN), nitroglycerine and mixtures thereof are particularly effective plasticizers.

Preferably the particulate triaminoguanidinium azide or triaminoguanidinium hydrazinium diazide employed in the present novel composition at a maximum will have a particle size of about 300 microns. Ordinarily these materials as used are within the range of from about 10 to about 150 microns in size.

The particle size of the nitramine oxidizer is not critical. Ordinarily, however, this component ranges from about 5 to about 300 microns in size.

The present propellants usually are fabricated by mixing and blending the fuel oxidizer and triaminoquanidinium azide and/or triaminoguanidinium hydrazinium diazide into the plasticized nitrocellulose binder, i.e. nitrosol binder. After mixing to provide a substantially homogeneous blend, the formulation is cast, extruded, or otherwise formed and cured to produce a solid elastomeric propellant grain of predetermined configuration. Ordinariy the cast grains are cured at a period of from about 16 to about 20 hours at a temperature of about 50°.

The propellant composition of the present invention is suitable for use in rocket and missile applications as a gun propellant and a gas generator.

The following Examples will serve to further illustrate the present invention but are not meant to limit it thereto.

EXAMPLE 1

A propellant grain was formulated by blending 22 weight percent triaminoguanidinium azide, 32 weight percent cyclotrimethylene trinitramine (RDX), 1 weight percent particulate aluminum powder (Reynolds 400), 1 weight percent toluene diisocyanate, 11 weight percent plastisol grade nitrocellulose, 5 weight percent diethyleneglycol dinitrate and 28 weight percent trimethylolethane trinitrate. The blended composition was cast into propellant grains or test specimens and these cured for about 16 hours at 50° C. The resulting cured grains were found to be substantially nonporous and had a density of about 100 percent of theory, i.e. 1.6 grams/cubic centimeter.

Sensitivity tests were conducted on both cured and uncured compositions. Using a standard Bureau of Mines Impact Sensitivity test apparatus having a two kilogram weight, in the uncured state the grains showed 50 percent fire level at 25.8 centimeters. This same fire level was found at 36 centimeters for the cured product. No fire level was found at 20 centimeters for the uncured product and at 25 centimeters for the cured grain. In the spark sensitivity measurement, the maximum energy for no fire was 1.25 joules for both the cured and uncured products. The delayed autoignition temperature was found to be 165° for both the cured and uncured product.

Samples of the blended formulation which had been cast into standard ASTM dogbone specimens after curing were tested on an Instron tensile test apparatus at a crosshead speed of two inches per minute. This test indicated the cured composition had a tensile strength of about 100 pounds per square inch. The elongation was found to be about 40 percent.

Closed bomb determinations on cured samples of this composition indicated a heat of explosion of 1,006±7 calories per gram indicating a bomb impulse of 234 seconds. This represents an efficiency of about 94.4 percent of theory.

A number of ¼ and ½ pound rocket engines were prepared using this propellant. These engines were cylindrical grains having a two inch outer diameter and a 1.5 inch internal perforation. The ½ pound engines were 6 inches long, the ¼ pound engines were about one-half that length. The engines after curing were fired using a closure and an electrical squib with 3 grams of igniter propellant as the igniter.

The measured strand burning rate for the cured propellant was 0.26 inch per second at 1000 pounds per square inch.

Motor firing traces indicated these engines burned smoothly with impulses in the ½ pound engines ranging from about 214 to about 226 seconds; this is about 88 to 92 percent of theory. For the ¼ pound engines efficiencies were from about 84 to 87 percent of theory. The exhaust temperature was about 1065° K.

Measurement of the exhaust products both for IR radiation and visible light indicated the present composition had a high transmittancy to these energies, a reduced luminosity and contained substantially only gaseous species. High speed color motion pictures also showed the desirable exhaust characteristics of the composition of the present invention.

EXAMPLE 2

A number of propellant compositions of the present invention were formulated, cast into either 0.25 or 0.5 pound motors and cured as set forth in Example 1. The composition data and combustion results are summarized in Table I.

Table I

| Run No. | Formulation NC | TMETN | Composition, (wt. %)[1] DEGDN | TAZ | RDX | Motor Size lb. | Impulse F° 1000 sec. | Efficiency % Theory | Exhaust Characteristics Light Energy % IR | Visible | Exhaust Stream Luminescence[2] % |
|---|---|---|---|---|---|---|---|---|---|---|---|
| 1 | 11.0 | 27.6 | 4.9 | 22.0 | 32.0 | 0.5 | 220.6 | 89.6 | 70 | 78 | 81 |
| 2 | 11.0 | 27.6 | 4.9 | 34.0 | 20.0 | 0.5 | 214.1 | 90.1 | 55 | 52 | 56 |
| 3 | 11.0 | 27.6 | 4.9 | 39.0 | 15.0 | 0.25 | 199.9 | 88.9 | 87 | 97 | 35 |
| 4 | 11.0 | 27.6 | 4.9 | 44.0 | 10.0 | 0.25 | 192.9 | 83.0 | 72 | 79 | 0 |
| 5 | 11.0 | 27.6 | 4.9 | 49.0 | 5.0 | 0.25 | 212.8 | 92.7 | 68 | 85 | 0 |

[1]Compositions all contained 1 per cent by weight finely divided aluminum (Reynolds 400) and 1.5 weight per cent toluene diisocyanate.
[2]Per cent of total exhaust stream exhibiting luminescent burning.

EXAMPLE 3

A number of propellant compositions of the present invention were prepared. The exhaust temperature and theoretical specific impulse were determined for each composition.

These formulation compositions and their combustion characteristics are summarized in Table II which follows:

Table II

| Run No. | NC | TMETN | DEGDN | TEGDN | THA | TAZ | HMX | RDX | Al | TDI | Exhaust Temp. °K | I° sp sec. |
|---|---|---|---|---|---|---|---|---|---|---|---|---|
| 1 | 10.0 | 30.0 | — | — | 5 | — | 53 | — | 2 | — | 1420 | 258.9 |
| 2 | 10.0 | 30.0 | — | — | 10 | — | 48 | — | 2 | — | 1341 | 257.1 |
| 3 | 10.0 | 30.0 | — | — | 20 | — | 38 | — | 2 | — | 1198 | 252.9 |
| 4 | 10.0 | 30.0 | — | — | 30 | — | 28 | — | 2 | — | 1071 | 248.3 |
| 5 | 12.5 | 37.5 | — | — | 5 | — | 43 | — | 2 | — | 1393 | 257.1 |
| 6 | 12.5 | 37.5 | — | — | 10 | — | 38 | — | 2 | — | 1315 | 255.1 |
| 7 | 12.5 | 37.5 | — | — | 20 | — | 28 | — | 2 | — | 1174 | 250.9 |
| 8 | 12.5 | 37.5 | — | — | 30 | — | 18 | — | 2 | — | 1051 | 246.0 |
| 9 | 10.0 | 30.0 | — | — | — | — | 58 | — | 2 | — | 1504 | 260.6 |
| 10 | 10.0 | 30.0 | — | — | — | 5 | 53 | — | 2 | — | 1415 | 258.7 |
| 11 | 10.0 | 30.0 | — | — | — | 10 | 48 | — | 2 | — | 1332 | 256.5 |
| 12 | 10.0 | 30.0 | — | — | — | 20 | 38 | — | 2 | — | 1181 | 251.8 |
| 13 | 10.0 | 30.0 | — | — | — | 30 | 28 | — | 2 | — | 1049 | 246.2 |
| 14 | 12.5 | 37.5 | — | — | — | — | 48 | — | 2 | — | 1474 | 258.7 |
| 15 | 12.5 | 37.5 | — | — | — | 5 | 43 | — | 2 | — | 1388 | 256.8 |
| 16 | 12.5 | 37.5 | — | — | — | 10 | 38 | — | 2 | — | 1306 | 254.6 |
| 17 | 12.5 | 37.5 | — | — | — | 20 | 28 | — | 2 | — | 1158 | 249.7 |
| 18 | 12.5 | 37.5 | — | — | — | 30 | 18 | — | 2 | — | 1029 | 243.9 |
| 19 | 10.0 | 30.0 | — | — | 5 | — | — | 53 | 2 | — | 1424 | 259.2 |

Table II -continued

| Run No. | NC | TMETN | DEGDN | TEGDN | THA | TAZ | HMX | RDX | Al | TDI | Exhaust Temp. ° K | I° sp sec. |
|---|---|---|---|---|---|---|---|---|---|---|---|---|
| 20 | 10.0 | 30.0 | — | — | 10 | — | — | 48 | 2 | — | 1344 | 257.3 |
| 21 | 10.0 | 30.0 | — | — | 20 | — | — | 38 | 2 | — | 1200 | 253.2 |
| 22 | 10.0 | 30.0 | — | — | 30 | — | — | 28 | 2 | — | 1073 | 248.6 |
| 23 | 12.5 | 37.5 | — | — | 5 | — | — | 43 | 2 | — | 1395 | 257.3 |
| 24 | 12.5 | 37.5 | — | — | 10 | — | — | 38 | 2 | — | 1315 | 255.3 |
| 25 | 12.5 | 37.5 | — | — | 20 | — | — | 28 | 2 | — | 1176 | 251.0 |
| 26 | 12.5 | 37.5 | — | — | 30 | — | — | 18 | 2 | — | 1053 | 246.2 |
| 27 | 10.0 | 30.0 | — | — | — | — | — | 58 | 2 | — | 1523 | 260.9 |
| 28 | 10.0 | 30.0 | — | — | — | 5 | — | 53 | 2 | — | 1431 | 259.1 |
| 29 | 10.0 | 30.0 | — | — | — | 10 | — | 48 | 2 | — | 1347 | 257.0 |
| 30 | 10.0 | 30.0 | — | — | — | 20 | — | 38 | 2 | — | 1192 | 252.3 |
| 31 | 10.0 | 30.0 | — | — | — | 30 | — | 28 | 2 | — | 1059 | 247.1 |
| 32 | 12.5 | 37.5 | — | — | — | — | — | 48 | 2 | — | 1491 | 259.1 |
| 33 | 12.5 | 37.5 | — | — | — | 5 | — | 43 | 2 | — | 1401 | 257.1 |
| 34 | 12.5 | 37.5 | — | — | — | 10 | — | 38 | 2 | — | 1318 | 255.0 |
| 35 | 12.5 | 37.5 | — | — | — | 20 | — | 28 | 2 | — | 1167 | 250.2 |
| 36 | 12.5 | 37.5 | — | — | — | 30 | — | 18 | 2 | — | 1040 | 244.8 |
| 37 | 15.0 | 45.0 | — | — | — | — | — | 38 | 2 | — | 1460 | 257.2 |
| 38 | 15.0 | 45.0 | — | — | — | 5 | — | 33 | 2 | — | 1373 | 255.1 |
| 39 | 15.0 | 45.0 | — | — | — | 10 | — | 28 | 2 | — | 1292 | 252.9 |
| 40 | 15.0 | 45.0 | — | — | — | 20 | — | 18 | 2 | — | 1143 | 248.0 |
| 41 | 11.0 | 34.0 | — | — | — | 22 | — | 32 | 1 | — | 1119 | 248.2 |
| 42 | 11.0 | 18.1 | — | 24.4 | — | 4 | — | 50 | 1 | 1.5 | 1103 | 240.6 |
| 43 | 11.1 | 18.1 | 14.1 | — | — | 4.0 | — | 50.2 | 1 | 1.5 | 1308 | 253.1 |
| 44 | 11.0 | 8.1 | — | 24.4 | — | 22 | — | 32 | 1 | 1.5 | 938 | 229.9 |
| 45 | 11.0 | 27.6 | — | 4.9 | — | 22 | — | 32 | 1 | 1.5 | 1035 | 242.3 |
| 46 | 11.0 | 8.1 | — | 24.4 | — | 34 | — | 20 | 1 | 1.5 | 925.6 | 223.7 |

In a manner similar to that described for the foregoing Examples other propellants having a low exhaust temperature, a satisfactory specific impulse, low exhaust luminosity and high infrared and visible light transmittancy can be prepared and formulated using the components set forth hereinbefore within the disclosed composition ranges.

Various modifications can be made in the present invention without departing from the spirit or scope thereof for it is understood that we limit ourselves only as defined in the appended claims.

We claim:

1. A propellant composition which comprises on a weight basis;

a. from about 5 to about 60 percent of a nitramine oxidizer, said oxidizer being a member selected from the group consisting of cyclotrimethylene trinitramine, cyclotetramethylene tetramine or mixtures thereof, b. from about 5 to about 60 percent of triaminoguanidinium azide, triaminoguanidinium hydrazinium diazide or mixtures thereof, and c. from about 35 to about 60 percent of a plasticized nitrocellulose binder.

2. The propellant composition as defined in claim 1 wherein the plasticized nitrocellulose binder consists of a mixture of from about 1 to 5 parts by weight of a nitroplasticizer to 1 part by weight of a plastisol grade nitrocellulose.

3. The propellant composition as defined in claim 1 which contains on a weight basis up to a total of 5 percent of stabilizers and combustion additives.

4. The propellant composition as defined in claim 1 wherein the plasticized nitrocellulose binder is from about 40 to about 50 weight percent of the total composition and consists of from 10 to about 12.5 percent based on the total composition weight of plastisol grade nitrocellulose and from about 30 to about 37.5 percent based on total composition weight of diethyleneglycol dinitrate, triethyleneglycol dinitrate, trimethylolethane trinitrate and mixtures thereof, and contains from about 5 to about 55 weight percent triaminoguanidinium azide, triaminoguanidinium hydrazinium diazide or mixtures thereof, the balance being cyclotrimethylene trinitramine, cyclotetramethylene tetramine or mixtures thereof.

5. A propellant composition which comprises on a weight basis a. about 22 percent triaminoguanidinium azide, b. about 32 percent cyclotrimethylene trinitramine, c. about 11 percent plastisol grade nitrocellulose, d. about 5 percent diethyleneglycol dinitrate, e. about 28 percent trimethylolethane trinitrate, f. about 1 percent toluene diisocyanate, and g. about 1 percent particulate aluminum.

* * * * *